US006805189B2

(12) United States Patent
Ervin

(10) Patent No.: US 6,805,189 B2
(45) Date of Patent: Oct. 19, 2004

(54) DIE CASTING

(75) Inventor: Leonard L. Ervin, Whitehall, MI (US)

(73) Assignee: Howmet Research Corporation, Whitehall, MI (US)

( * ) Notice: Subject to any disclaimer, the term of this patent is extended or adjusted under 35 U.S.C. 154(b) by 0 days.

(21) Appl. No.: 10/285,344

(22) Filed: Oct. 30, 2002

(65) Prior Publication Data

US 2004/0084170 A1 May 6, 2004

(51) Int. Cl.[7] ..... B22D 27/09; B22D 13/99
(52) U.S. Cl. ..... 164/119; 164/120; 164/113
(58) Field of Search ..... 164/113, 119, 164/120

(56) References Cited

U.S. PATENT DOCUMENTS

| | | | | | |
|---|---|---|---|---|---|
| 4,049,040 | A | * | 9/1977 | Lynch | 164/120 |
| 4,512,383 | A | | 4/1985 | Suzuki et al. | 164/35 |
| 4,534,402 | A | | 8/1985 | Watts | 164/302 |
| 4,687,042 | A | * | 8/1987 | Young | 164/80 |
| 4,967,826 | A | * | 11/1990 | Kopp et al. | 164/76.1 |
| 5,205,338 | A | | 4/1993 | Shimmell | 164/113 |
| 5,323,838 | A | | 6/1994 | Hamashima et al. | 164/113 |
| 5,529,111 | A | | 6/1996 | Freeman | 164/149 |
| 5,662,156 | A | | 9/1997 | Freeman | 164/61 |
| 5,730,199 | A | | 3/1998 | Shimmell | 164/4.1 |
| 5,758,711 | A | * | 6/1998 | Ratte | 164/312 |
| 5,842,510 | A | | 12/1998 | Nagashima et al. | 164/72 |
| 5,957,192 | A | | 9/1999 | Kitamura et al. | 164/457 |
| 5,979,535 | A | | 11/1999 | Sakamoto et al. | 164/113 |
| 5,983,977 | A | | 11/1999 | Nishimura et al. | 164/312 |
| 6,039,108 | A | | 3/2000 | Hanano et al. | 164/72 |
| 6,098,700 | A | | 8/2000 | Carden et al. | 164/312 |
| 6,340,049 | B1 | | 1/2002 | Lehman et al. | 164/471 |
| 6,662,852 | B2 | * | 12/2003 | Gegel | 164/98 |
| 2001/0045266 | A1 | | 11/2001 | Kono | 164/113 |
| 2001/0052403 | A1 | | 12/2001 | Mortari | 164/72 |
| 2001/0054492 | A1 | | 12/2001 | Hanano | 164/312 |
| 2002/0007883 | A1 | | 1/2002 | Doutre et al. | 148/549 |
| 2002/0017373 | A1 | | 2/2002 | Fest | 164/445 |
| 2002/0023728 | A1 | | 2/2002 | Kikuchi et al. | 164/113 |

FOREIGN PATENT DOCUMENTS

JP 405131255 A 5/1993

* cited by examiner

*Primary Examiner*—Kiley Stoner
*Assistant Examiner*—Len Tran
(74) *Attorney, Agent, or Firm*—Edward J. Timmer

(57) ABSTRACT

Method and apparatus for making a cast product shape using a die casting method wherein a molten metallic material is introduced into a shot sleeve having an end that is closed by a movable closure member. The molten metallic material is forced by movement of a plunger in the shot sleeve to the closed end of the shot sleeve where the plunger maintains pressure on the metallic material until it is at least partially solidified in the shot sleeve in the form of a cast product having a outer peripheral shape corresponding to the inner peripheral shape of the shot sleeve. The end of the shot sleeve then is opened by relative movement of the closure member and the shot sleeve, and the plunger is moved further to eject the product shape from the open end of the shot sleeve.

11 Claims, 5 Drawing Sheets

DIE CASTING

FIELD OF THE INVENTION

The present invention relates to die casting of a molten metallic material in a shot sleeve.

BACKGROUND OF THE INVENTION

Sputtering is a commonly used deposition process to deposit a coating on a substrate. In a typical sputtering process, a target is impinged with high energy electrons or other atomic particles to dislodge material from the target for deposition on the substrate. Certain sputter targets contain a significant weight fraction of one or more precious and/or expensive metals. As a result, raw material costs are a substantial proportion of the final product (target) cost. In the past, disk-shaped sputter targets have been made using powder metallurgical and wrought metal fabrication processes.

U.S. Pat. No. 6,070,643 describes a vacuum die casting apparatus and method especially useful for die casting reactive metals and alloys.

SUMMARY OF THE INVENTION

The present invention provides a method for making a cast product using a die casting method wherein a molten metallic material is introduced into a shot sleeve having an end that is closed by a relative movement between a closure member and the shot sleeve. The molten metallic material is forced by movement of a plunger in the shot sleeve to the closed end of the shot sleeve where the plunger maintains pressure on the metallic material until it is at least partially solidified in the shot sleeve in the form of a cast product shape having a outer peripheral shape corresponding to the inner peripheral shape of the shot sleeve. The end of the shot sleeve then is opened by relative movement between the closure member and the shot sleeve, and the plunger is moved further to eject the cast product from the open end of the shot sleeve. The invention is useful, although not limited to, making disk-shaped cast sputter targets.

In an illustrative embodiment of the invention, the metallic material is melted under subambient pressure (relative vacuum) that is also provided in the shot sleeve. In another illustrative embodiment of the invention, a plug is placed in front of and axially spaced from the plunger in the shot sleeve, and the molten metallic material is introduced between the plunger and the plug. The plunger is moved in the shot sleeve so that the plug abuts the closure member and so that the molten metallic material can solidify between the plunger and the plug. The plug can be configured to impart a desired shape to an end face of the cast product which contacts the plug. The plunger tip can be appropriately configured to impart a desired shape to an end face of the cast product which contacts the plunger tip.

The present invention is advantageous to conserve the metallic material since no disposable gating and runner systems are needed which are filled with the metallic material. The molten metallic material is solidified in the shot sleeve, eliminating the need for machined die set having a die cavity. The use of plunger pressure on the solidifying metallic material in the shot sleeve reduces shrinkage porosity that may occur as the molten metallic material solidifies. The invention can produce net or near net shape die cast components having an outer periphery corresponding to the inner periphery of the shot sleeve and one or more end faces or surfaces having a desired configuration.

Details of the present invention will become more readily apparent from the following detailed description taken with the following drawings.

DETAILED DESCRIPTION OF THE INVENTION

Figure 1:
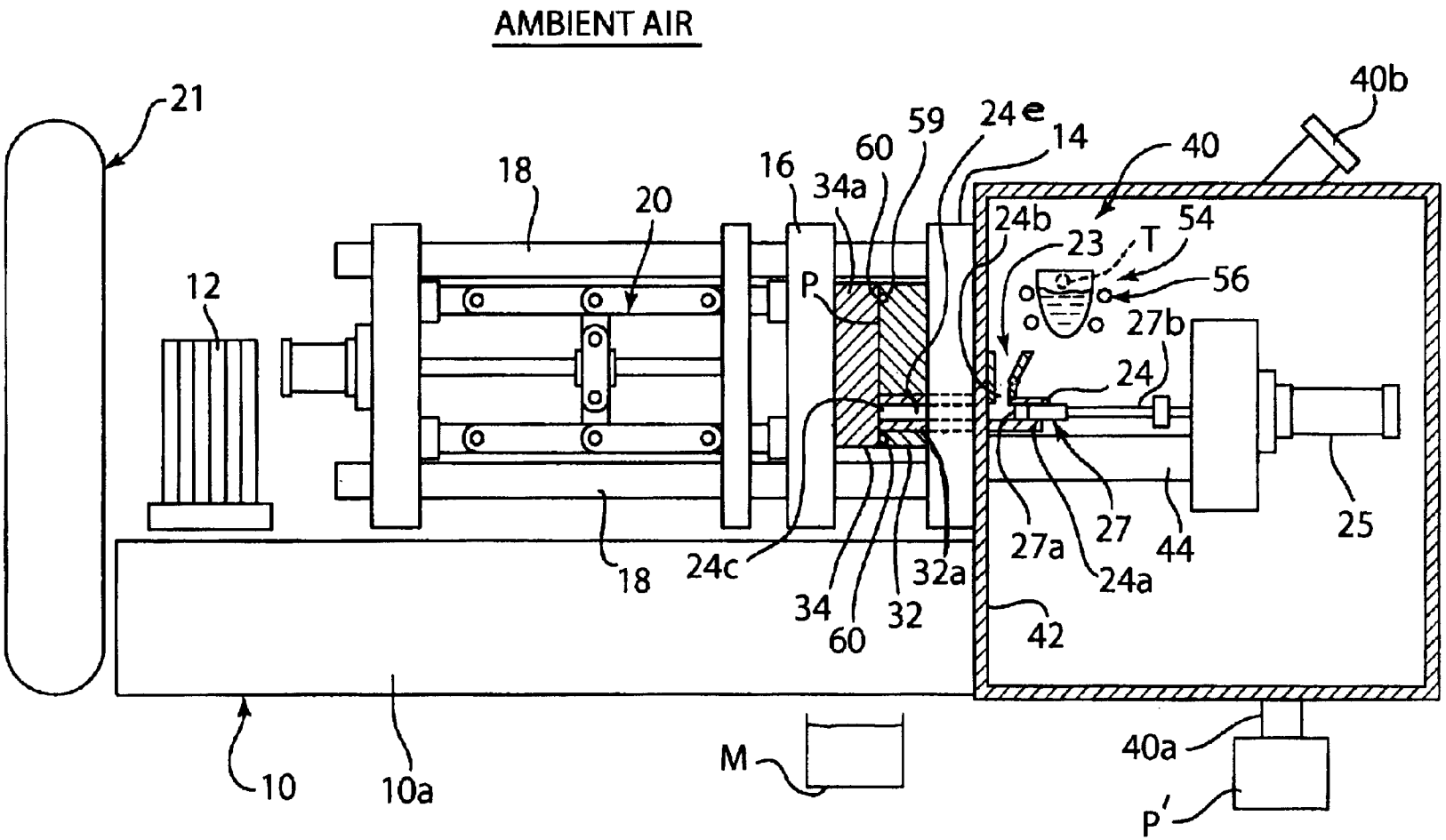
FIG. 1 is a schematic side elevation of a vacuum die casting machine for practicing an embodiment of the present invention with the shot sleeve, dies, and vacuum chamber shown broken away.

For purposes of illustration and not limitation, FIG. 1 shows a die casting machine that can be used to practice an embodiment of the invention wherein the metallic material (e.g. a metal or alloy) to be cast is melted under subambient pressure and introduced into the shot sleeve also maintained under subambient pressure. The die casting machine is described in U.S. Pat. No. 6,070,643, the teachings of which are incorporated herein by reference. The die casting machine comprises a base 10 which defines therein a reservoir 10*a* for hydraulic fluid that is used by hydraulic actuator 12 to open and close the fixed and movable platens 14, 16. The platen 16 is disposed for movement on stationary tie bars or rods 18. A die clamping linkage mechanism 20 is connected to the movable platen 16 in conventional manner to move the platen 16 relative to fixed or stationary platen 14. For example, a conventional die casting machine available as 250 ton HPM #73-086 from HPM, Cleveland, Ohio, includes such a base 10, actuator 12, and platens 14, 16 mounted on tie bars 18 and opened/closed by die clamping linkage mechanism 20 in the manner described. The die casting machine includes a gas accumulator 21 for rapid feeding of hydraulic fluid to the plunger mechanism.

Pursuant to an embodiment of the invention, the die casting machine comprises a tubular shot sleeve 24 having a charging end 24*a* that includes an opening 24*b* to receive molten metal or alloy from an upstanding melt-receiving vessel or spout 23 mounted adjacent the fixed platen 14 on the shot sleeve 24 by clamps such as screw clamps (not shown). The shot sleeve 24 also includes an opposite end 24*c* that is shown closed by a movable closure member 34 in the form of a flat plate 34*a* fastened to movable platen 16 in FIGS. 1–3 and that is shown open in FIG. 4.

Figure 2:
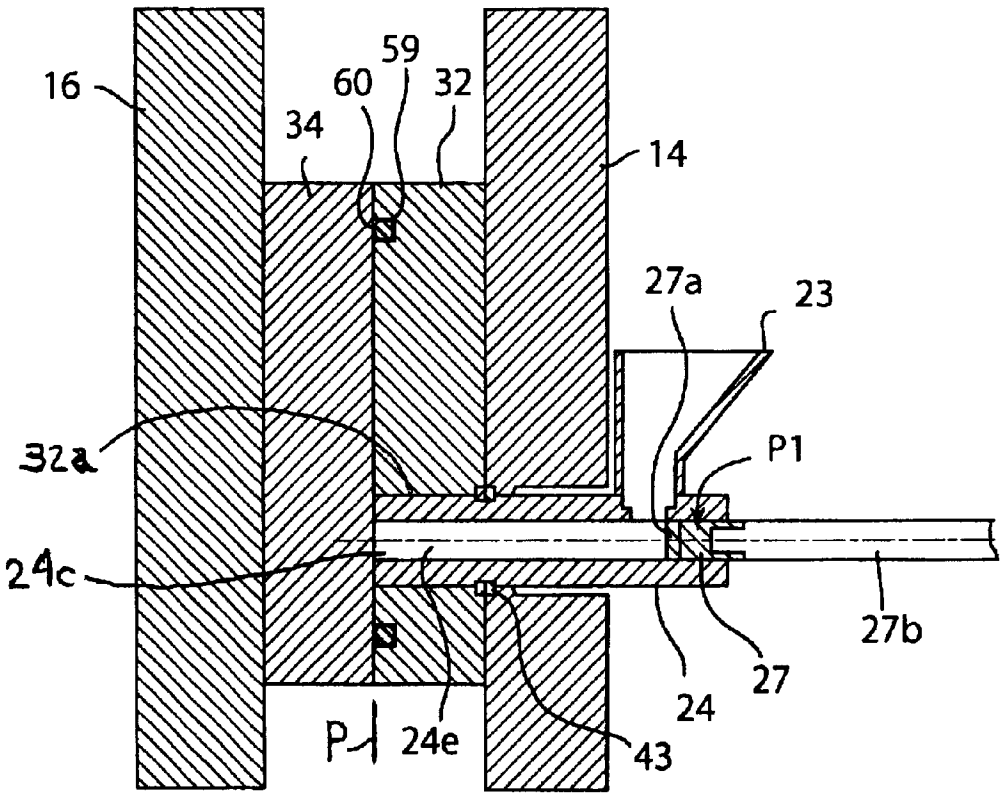
FIG. 2 is a longitudinal sectional view of the shot sleeve, plunger and closure member of the die casting machine pursuant to an embodiment of the invention before die casting of molten metallic material in the shot sleeve.
Figure 3:
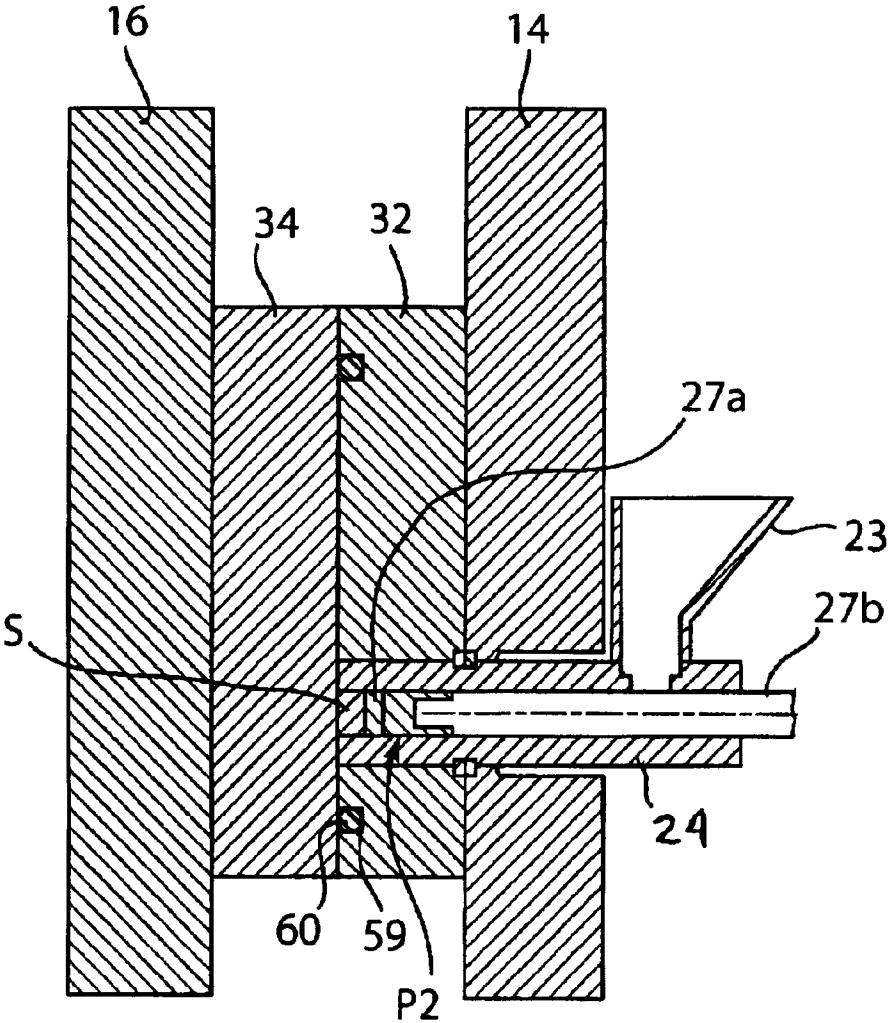
FIG. 3 is a longitudinal sectional view of the shot sleeve, plunger and closure member of the die casting machine pursuant to an embodiment of the invention after die casting of molten metallic material in the shot sleeve.

The charging end 24*a* of the shot sleeve 24 extends through a passage 32*a* in stationary plate 32 fastened on stationary platen 14. The opposite open end 24*c* of the shot sleeve 24 terminates at the plane P defined by plates 32, 34 when abutted together as shown in FIGS. 1–3. Closure member 34 (plate 34*a*) closes off the open end 24*c* of the shot sleeve 24 when the closure member 34 and plate 32 are abutted as shown in FIG. 2.

In an illustrative embodiment of the invention, the charging end 24*a* of the shot sleeve 24 extends into a vacuum melting chamber 40 where a molten metal or alloy to be cast is heated in a crucible 54 under relatively high vacuum conditions such as less than 50 microns and for example about 5 to about 50 microns. The crucible can comprise an induction melting crucible having an induction coil 56 thereabout in conventional manner to heat and melt a solid metal or alloy charge therein. Alternately, the crucible may be a melt holding crucible adapted to receive molten metal or alloy from a vacuum melting crucible (not shown) located outside the chamber 40.

If the crucible 54 is a melting crucible, it can comprise an induction skull crucible comprising copper segments in which a charge of solid wrought aluminum alloy to be die cast is charged via vacuum port 40*b* and melted by energization of induction coil 56. Known ceramic or refractory (e.g. graphite) lined crucibles 54 also can be used in practicing the present invention.

The melt-receiving vessel or spout 23 is disposed beneath crucible 54 to receive a charge of molten metal or alloy therefrom for casting. The molten metal or alloy charge is introduced from crucible 54 through opening 24*b* into the shot sleeve 24 in front of a plunger tip 27*a*. The crucible 54 can be tilted by rotation about crucible trunnions T using a conventional hydraulic, electrical or other actuator (not shown) disposed outside the vacuum chamber 40 and connected to the crucible by suitable vacuum sealed linkage extending from the actuator to the crucible.

The plunger 27 has plunger tip 27*a* disposed in the charging end 24*a* of the shot sleeve 24 for movement toward the end 24*c* of the shot sleeve closed by closure member 34. The plunger 27 is moved from the start injection position P1 shown in FIG. 2 to a final injection position P2 shown in FIG. 3 by connection of a plunger connector rod 27*b* to a conventional hydraulic actuator 25 that, for example, is provided on the aforementioned conventional die casting machine. Typical radial clearance between the shot sleeve 24 and the plunger tip 27*a* is in the range of about 0.001 inch to 0.020 inch.

The vacuum chamber 40 is defined by a vacuum housing wall 42 that extends about and encompasses or surrounds the charging end 24*a* of the shot sleeve 24. The vacuum chamber 40 is evacuated by one or more conventional vacuum pumps P' connected to the chamber 40 by a conduit 40*a*. The base 10 and the vacuum housing wall 42 rest on a concrete floor or other suitable support.

The chamber wall 42 is airtight sealed with the fixed platen 14 by one or more peripheral airtight seals 43 located therebetween so as to sealingly enclose the shot sleeve end 24*a* and a pair of side-by-side stationary, horizontal shot sleeve/plunger support members 44 (one shown) extending through chamber wall 42. Such shot sleeve/plunger support members are provided on the aforementioned conventional die casting machine (250 ton HPM #73-086).

The chamber 24*e* defined within the shot sleeve 24 is communicated to the vacuum chamber 40 via the shot sleeve opening 24*b* and is evacuated through the opening 24*b*. The stationary plate 32 typically includes a series of grooves (one groove 59 being shown) on its inner face adjacent the opposing inner face of the movable closure member 34 when it is abutted against plate 32 as shown in FIG. 2. The grooves encircle or extend about the end 24*c* of the shot sleeve 24. Each groove receives a respective resilient, reusable high temperature O-ring vacuum seal 60 for sealing in vacuum tight manner against the mating face of the movable closure member 34 when it is abutted against fixed plate 32. Only one groove 59 and seal 60 are shown for convenience. Alternately, the seal(s) 60 can be disposed in grooves on the mating face of the movable closure member 34, or on the mating faces of both closure member 34 and plate 32, so as to form a vacuum tight seal about and isolating the end 24*c* of the shot sleeve from the ambient air atmosphere surrounding the exterior of the closure member 34 and plate 32. The vacuum seals 60 may comprises Viton material that can withstand temperatures as high as 400 degrees F. that may be present when the shot sleeve 24 contains molten metal or alloy.

By use of vacuum seals 60, the chamber 24*e* of the shot sleeve 24 is isolated from the ambient air atmosphere when the closure member 34 and plate 32 are abutted and enables the chamber 24*e* to be evacuated through the shot sleeve opening 24*b* when the vacuum melting chamber 40 is evacuated to the aforementioned high vacuum levels.

The closure member 34 and plate 32 optionally can be maintained at a superambient temperature during casting, although unheated dies may be used in casting certain metal or alloys. For example, closure member 34 and plate 32 can be heated prior to injection of the molten metal or alloy in the shot sleeve 24 by one or more conventional electrical resistance rod heating elements (not shown) received in channels in the closure member 34 and plate 32, by gas flame burners, or any other conventional die heating means. Or, the closure member 34 and plate 32 can be self-heated as a result of prior injection of molten metal or alloy charge(s) in the shot sleeve 24. The closure member 34 and plate 32 also may be cooled by water cooling conduits (not shown) formed internally thereof and through which cooling water is circulated to control temperature of the closure member 34 and plate 32 in a particular range. The shot sleeve 24 similarly optionally can be heated or cooled to control shot sleeve temperature within a desired range using similar heating and cooling devices.

The shot sleeve 24, closure member 34 and plate 32 can be made of steel or other suitable material depending upon the metal or alloy to be cast. The plunger tip 27*a* can comprise beryllium copper alloy or other suitable material depending upon the metal or alloy to be cast. The shot sleeve wall thickness is ¾ inch, although other ticknesses can be used.

In accordance with an illustrative embodiment of the invention, a charge of molten metallic material (metal or alloy) is introduced from crucible 54 through opening 24*b* into the shot sleeve 24 in front of plunger tip 27*a* at position P1, FIG. 2, while the closure member 34 closes off the open end 24*c* of the shot sleeve 24. The vacuum chamber 40 and the shot sleeve chamber 24*e* are maintained at subambient pressure (relative vacuum) as a result of evacuation of chamber 40 as described above before and after the molten metallic material charge is introduced into the shot sleeve.

The actuator 25 then moves the plunger 27 along the shot sleeve 24 to force the molten metallic material charge to the closed end 24*c* of the shot sleeve 24, FIG. 3, where the plunger 27 maintains pressure on the metallic material until it is at least partially solidified, typically almost completely solidified, in the shot sleeve end 24*c* in the form of a cast product S having a outer peripheral shape corresponding to the inner peripheral shape of the shot sleeve 24. That is, the metallic material solidifies in the axial space formed between the plunger tip 27*a* and the closure member 34 and enclosed peripherally by a length of the shot sleeve 24.

For a tubular cylindrical shot sleeve 24 and cylindrical plunger tip 27*a*, the cast product S will comprise a cylindrical disk having a circular outer periphery (circumference) corresponding to the circular inner periphery (inner circumference) of the shot sleeve 24 and an axial thickness that is determined by the amount of metallic material introduced into the shot sleeve 24 and the final position P2 of the plunger 27. The invention thus is useful in making cast sputter targets of disk shape, which for purposes of illustration may have a composition, in weight %, of 60 to 70% Co, 10 to 20% Cr, 5 to 15% Ni and 0.5 to 10% B, although the invention is not limited to such cylindrical product shapes and compositions. Other product shapes and compositions can be made in practice of the invention depending upon the cross-sectional shape of the shot sleeve 24 and plunger tip 27*a* as well as the metal or alloy to be cast.

Figure 4:
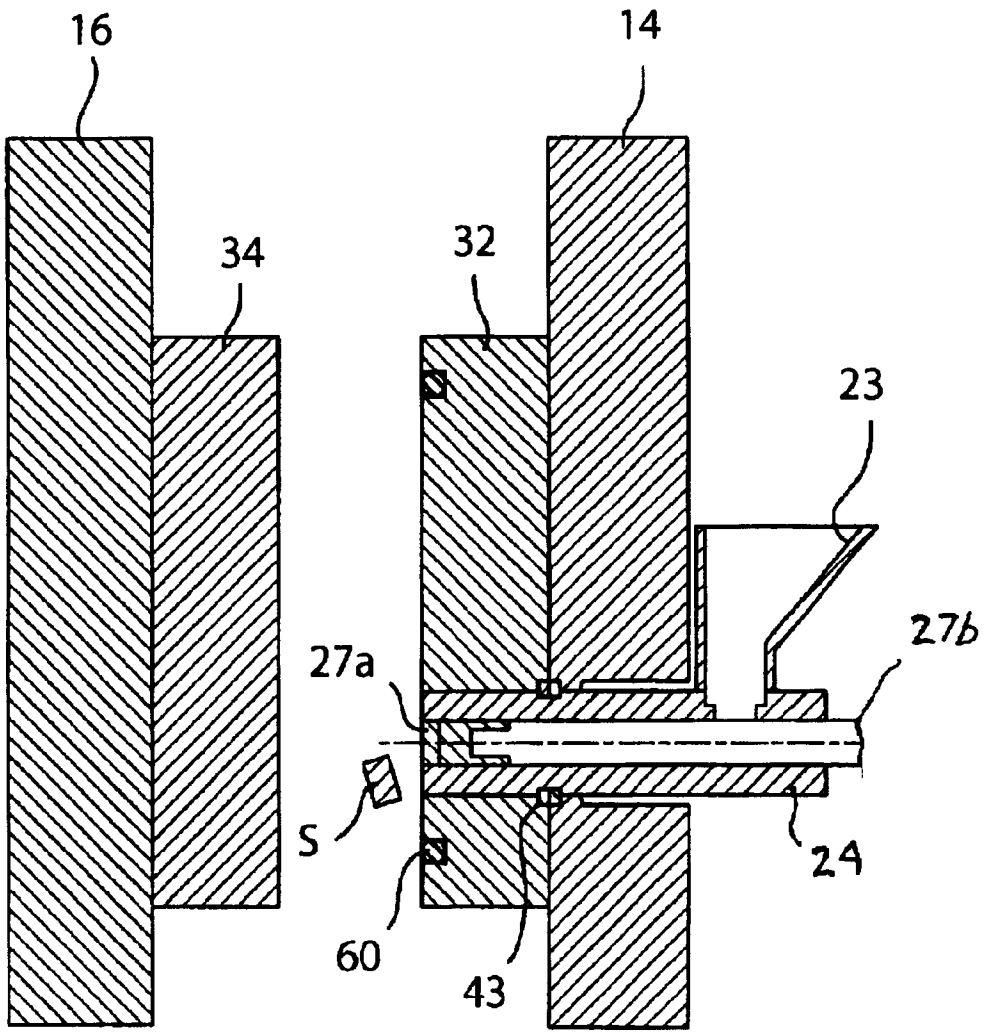
FIG. 4 is a longitudinal sectional view of the shot sleeve, plunger and closure member of the die casting machine pursuant to an embodiment of the invention after the die cast product is ejected from the open end of the shot sleeve.

After the cast product S is at least partially solidified so as to be ejected, the end 24*c* of the shot sleeve 24 is opened, FIG. 4, by movement of the closure member 34 away from the shot sleeve 24 and, and the plunger 24 is moved further toward the open end 24*c* to eject the cast product S from the now open end 24*c* of the shot sleeve 24. The cast product S optionally can be immediately quenched after ejection from the shot sleeve in a quenchant medium M, such as for example water or oil. The ejected cast product S also can be subjected to further treatments that can include, but are not limited, to consolidation by hot or cold isostatic compression, heat treatment, machining, and the like.

Figure 5:
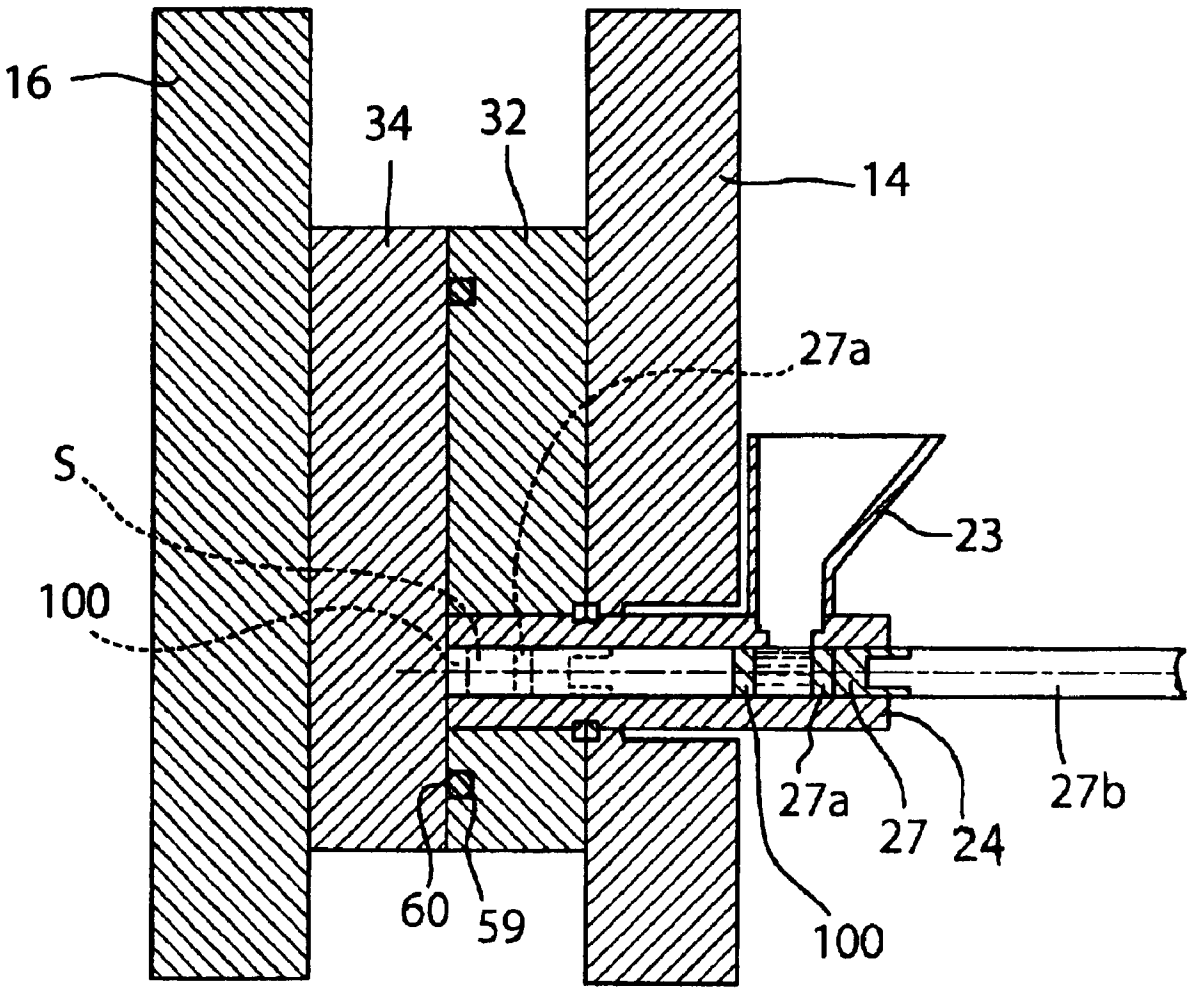
FIG. 5 is a longitudinal sectional view of the shot sleeve, plunger and closure member of the die casting machine pursuant to another embodiment of the invention.

Referring to FIG. 5, another illustrative embodiment of the invention is shown. This embodiment differs from the embodiment described above in that a plug member 100 is placed in front of and spaced axially from the plunger tip 27*a* in the shot sleeve 24 at position P1. The molten metallic material charge is introduced between the plunger tip 27*a* and the plug 100. The plunger 27 is moved in the shot sleeve 24 to move the charge and the plug 100 proximate the closure member 34 where the plug 100 abuts the closure member 34 as shown in dashed lines in FIG. 5. The molten metallic material can solidify between the plunger tip 27*a* and the plug 100 while pressure is applied on the charge by plunger 27. The plug 100 is made of a material resistant to the molten metal or alloy being cast. The plug 100 can be configured to impart a desired shape to an end face of the cast product S which contacts the plug 100. The plunger tip 27*a* likewise can be appropriately configured to impart a desired shape to an end face of the cast product S which contacts the plunger tip 27*a*.

The following example is offered to further illustrate but not limit the invention.

EXAMPLE

A sputter target alloy comprising Co, Cr, Ni and B was melted in crucible 54 under a vacuum level of 8 microns. A charge of 3.5 pounds was melted. The alloy was heated to its melting temperature plus 50 degrees F. to provide superheat relative to the alloy melting temperature. The melted alloy charge was poured from the crucible through opening 24*b* into the shot sleeve 24 and forced at 30 inches/second plunger speed to the shot sleeve end 24*c* closed by the closure member 34. The shot sleeve had an inner diameter of 3.0 inches. The shot sleeve and closure member were made of H13 steel and were not preheated. The plunger tip was made of beryllium copper alloy. The plunger continued to apply intensification pressure at a maximum calculated hydrostatic pressure of 4000 psi on the alloy in the shot sleeve for a time of 3 seconds such that the alloy was fully solidified through its cross-section while under intensification pressure. The closure member 34 then was opened and the solidified cast sputter target disk was ejected from the shot sleeve by moving the plunger toward the open shot sleeve end 24*c*. The cast sputter target disk had a diameter of 3 inches and thickness of 1.7 inch.

Practice of the present invention is advantageous to conserve the metallic material since no gating and runner systems are needed which are filled with metallic material. The molten metallic material is solidified in the shot sleeve 24, eliminating the need for machined die set. The use of plunger pressure on the solidifying metallic material in the shot sleeve reduces shrinkage porosity that may occur as the molten metallic material solidifies. The invention can produce net or near net shape die cast components having an outer periphery corresponding to the inner periphery of the shot sleeve and one or more end faces or surfaces having desired shape.

While the invention has been described in terms of specific embodiments thereof, it is not intended to be thereto but rather only to the extent set forth in the following claims.

I claim:

1. A method of making a cast product, comprising introducing a molten metallic material into a shot sleeve having an end that is closed by relative movement between the shot sleeve and a closure member, forcing the molten metallic material by movement of a plunger in the shot sleeve to the closed end of the shot sleeve where the plunger maintains pressure on the metallic material until it is at least partially solidified in and along a portion of a length of the shot sleeve to form the cast product, relatively moving the closure member and the shot sleeve to open the end of the shot sleeve, and moving the plunger in the shot sleeve to eject the cast product through the open end of the shot sleeve.

2. The method of claim 1 wherein the cast product has an outer peripheral shape corresponding to an inner peripheral shape of the shot sleeve.

3. The method of claim 1 wherein the end of the shot sleeve is closed by moving the closure member relative to the shot sleeve.

4. The method of claim 1 wherein the end of the shot sleeve is opened by moving the closure member relative to the shot sleeve.

5. The method of claim 1 including melting the metallic material under a subambient pressure that is also provided in the shot sleeve.

6. The method of claim 1 including placing a plug in front of and axially spaced from the plunger in the shot sleeve and introducing the molten metallic material between the plunger and the plug in the shot sleeve.

7. The method of claim 6 including moving the plunger in the shot sleeve to position the plug abutting the closure member, and solidifying the molten metallic material between the plunger and the plug.

8. The method of claim 6 wherein the plug is configured to impart a complementary configuration to an end face of the cast product which contacts the plug.

9. The method of claim 1 wherein the plunger has a tip that is configured to impart a complementary configuration to an end face of the cast product which contacts the plunger tip.

10. The method of claim 1 wherein the cast product comprises a disk-shaped sputter target at least partially solidified in and along the portion of the length of the shot sleeve.

11. A method of making a cast product, comprising introducing a molten metallic material into a shot sleeve having an end that is closed by relative movement between the shot sleeve and a closure member, forcing the molten metallic material by movement of a plunger in the shot sleeve to the closed end of the shot sleeve where the plunger maintains pressure on the metallic material until it is at least partially solidified in the shot sleeve to form the cast product such that an inner peripheral shape of the shot sleeve is imparted as an outer peripheral shape to the cast product, relatively moving the closure member and the shot sleeve to open the end of the shot sleeve, and moving the plunger in the shot sleeve to eject the cast product through the open end of the shot sleeve.

* * * * *